US007091944B2

(12) United States Patent
Wang

(10) Patent No.: US 7,091,944 B2
(45) Date of Patent: Aug. 15, 2006

(54) DISPLAY CONTROLLER

(75) Inventor: Shi-Chang Wang, Sunnyvale, CA (US)

(73) Assignee: LSI Logic Corporation, Milpitas, CA (US)

( * ) Notice: Subject to any disclaimer, the term of this patent is extended or adjusted under 35 U.S.C. 154(b) by 108 days.

(21) Appl. No.: 10/287,280

(22) Filed: Nov. 3, 2002

(65) Prior Publication Data

US 2004/0085283 A1 May 6, 2004

(51) Int. Cl.
*G09G 3/36* (2006.01)
*G09G 5/02* (2006.01)

(52) U.S. Cl. ..... 345/100; 345/98; 345/699; 348/419.1

(58) Field of Classification Search ..... 345/55, 345/84, 87, 98, 100, 204, 691, 698, 699, 345/99
See application file for complete search history.

(56) References Cited

U.S. PATENT DOCUMENTS 5,142,537 A * 8/1992 Kutner et al. ..... 714/747
5,467,138 A * 11/1995 Gove ..... 348/452
5,959,636 A * 9/1999 Lin et al. ..... 345/501
6,188,729 B1 * 2/2001 Perkins ..... 375/240.2
6,295,322 B1 * 9/2001 Arbeiter et al. ..... 375/240.29
6,429,902 B1 * 8/2002 Har-Chen et al. ..... 348/518
6,763,067 B1 * 7/2004 Hurst ..... 375/240.03
2002/0078317 A1 * 6/2002 Yasoshima ..... 711/171
2002/0080269 A1 * 6/2002 Gotanda et al. ..... 348/448
2002/0145610 A1 * 10/2002 Barilovits et al. ..... 345/538
2003/0011588 A1 * 1/2003 Kim ..... 345/213
2003/0156639 A1 * 8/2003 Liang ..... 375/240.01
2003/0172220 A1 * 9/2003 Hao ..... 710/305

* cited by examiner

*Primary Examiner*—Amare Mengistu
*Assistant Examiner*—Alexander S. Beck
(74) *Attorney, Agent, or Firm*—Christopher P. Maiorana, P.C.

(57) ABSTRACT

Systems and methods are disclosed for controlling a display device having a display scan line rate by storing incoming data in a buffer, the buffer having a usage level measure; comparing the usage level to the display scan line rate; and adjusting a width of a display scan line to avoid buffer overflow or underflow. The system avoids a costly external frame buffer and automatically handles uncertainties such as jitter in input and output clocks when the system operates in different environments.

23 Claims, 6 Drawing Sheets

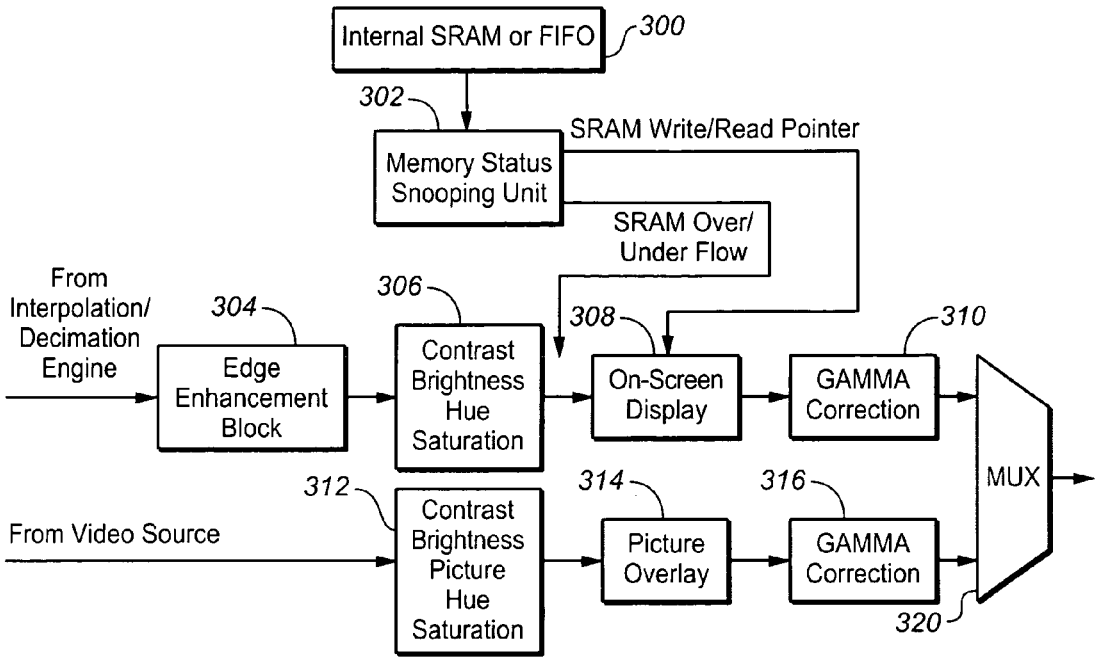

FIG. 5

| |
|---|
| 1. Read data from SRAM FIFO. |
| 2. Perform matrix interpolation/decimation block. |
| 3. If buffer overflow or underflow occurred, adjust period of output video clock so to stop the overflow or underflow. |
| 4. Perform post processing. |
| 5. Output to panel interface. |

FIG. 6

| |
|---|
| Incoming data is horizontally scaled 702 |
| Horizontally scaled data is presented to a ring buffer FIFO 704 |
| Diagonal Y-scaling operation is performed 706 |
| Horizontal scaling operation is performed 708 |

FIG. 7

DISPLAY CONTROLLER

COPYRIGHT RIGHTS

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

The present invention relates to display controllers for digital display devices such as liquid crystal displays, plasma displays and progressive-scan televisions.

One commonly used type of display panel is a liquid crystal display (LCD) panel. An LCD display panel is a rectangular grid of rectangular or square dots. The grid includes transparent electrodes laid out in horizontal rows on one thin pane, and in vertical columns on the other. The liquid crystal formula trapped in between the panes reacts to an electrical field applied to each electrode in the rows and columns. This reaction rotates the polarization of light transmitted through the LCD display. Polarizing layers outside the panes cause the dots to appear light or dark as the polarization changes.

The display is controlled by continuously feeding dot data to the display. The data is organized into individual pixels, rows of pixels, and full-page frames. A set of rows makes up a frame, which is one full page of the display. LCD data is continuously sent to the LCD panel to refresh the display frame. Since most LCD displays have no on-board frame buffer memory, the display data must be continuously refreshed. To get a stable, flicker-free image, the display data is sent to the panel at a frame refresh rate (referred to herein as the "frame rate") which falls within a range normally specified by the LCD panel manufacturer. An LCD panel manufacturer may specify, for example, that best results are obtained, i.e., a stable, flicker-free image, when the display data is sent to the panel 60 to 70 times per second, or 60 Hz to 70 Hz.

The LCD may be driven by different computers with different display resolutions. To insure the minimum level of interoperability between a digital flat panel (DFP) compliant monitor and host, both the monitor and host must support the video modes 640×400-60 Hz, 720×400-60 Hz, and 640×480-60 Hz. The DFP monitor must produce a viewable image with all of these video modes. The pixel clock for 640×400 and 720×400 shall be scaled down so the refresh rate is adjusted from 70 Hz to 60 Hz. The definition of a viewable image is all pixels are visible to the end user. Note that this does not mean that the monitor must support scaling or centering. It is considered acceptable for the image to be displayed in the upper left corner of the LCD. Monitors that have a native resolution of 640×480 are not required to fully display 720×400. If a DFP monitor is bundled with a DFP host or video card that does support scaling or centering, the monitor may rely on the host and is not required to provide this lower resolution support.

To illustrate, a VGA 640×480 pixel screen output can be displayed in a reduced area on a 1024×768 SVGA flat panel display. This type of display method would leave 384 pixels blank at the right of the screen and 288 blank lines at the bottom of the page. To increase the usable screen area, both horizontal and vertical expansion, preferably by the correct scale factor, are required. The image expanding can be done by replication of pixels horizontally or vertically or both. Typically, vertical lines may be added by periodically replicating the pixels of the preceding line to provide the desired expansion factor. However, horizontal expansion of character data is not provided because the character clock is typically used to clock the display, this being a submultiple of the pixel clock rate. Thus, the aspect ratio of text screens may be distorted by the vertical expansion without a corresponding horizontal expansion.

Another approach in flat panel technology replicates pixels vertically using the panel logic to simultaneously activate two row drivers at selected times. The column drivers are usually split into several chips and all of them must be driven simultaneously during one line scan, making it impossible to replicate pixels horizontally.

U.S. Pat. No. 5,600,347 discloses a system for horizontal expansion of low resolution display modes onto high resolution displays at a variable scaling factor. Two different methods are provided for graphics and text modes to attain better screen image quality. In the first method, a first pixel data sequence to be expanded is first oversampled at a multiple of the frequency thereof to produce an intermediate oversampled data sequence. The oversampled data sequence is linearly decimated by a factor of less than unity to produce a replicated second data sequence longer than the first, which is then displayed. In the second method, the intermediate oversampled data sequence is filtered to provide an interpolated oversampled data sequence, which is then decimated instead of the intermediate oversampled data sequence, to further improve the screen image quality.

U.S. Pat. No. 6,177,922 discloses a method and apparatus for producing video signal timing for a display device that has a display format different from the input video format. The system performs variable scale horizontal expansion of a first sequence of data elements to a second longer sequence of data elements for higher resolution display, in which the first data sequence is oversampled at a multiple of the frequency thereof, and then linearly decimated by a factor of less than unity to produce the second data sequence. The variable scale horizontal expansion is performed with a scaling factor (m/n). Horizontal expansion of a first sequence of data elements by a factor of two is performed, followed by horizontal compression by a factor of (m/2n). For example, a 640 pixel line may be expanded to 1024 pixels by first replicating every pixel to derive 1280 pixels, and then decimating the result by deleting (2n−m) pixels out of every 2n pixels. In operation with a typical computer graphics subsystem, the controller chip runs with its pixel clock rate divided by 2 and its output oversampled by a factor of 2. Then, selected pixel clock signals are deleted by the decimator logic. Although there are discontinuities in the pixel clock rate, the output pixels are compressed into the flat panel display because the data are first clocked into the display and then latched for a whole line period while the next line is assembled. Any screen compression ratio between 1 and 2 may thus be achieved by deleting the appropriate number of pixel clocks. Expansion by factors of more than 2 may also be achieved by increasing the oversampling ratio prior to decimation. When combined with vertical expansion methods, the system may be used to only perform expansion to any size of flat panel display from a lower resolution image.

Conventional image scaling controllers require their output clock to the LCD panel interface to match their input clock at a fixed rate to keep the frame rate equal between the input to each controller and the output to the LCD panel interface.

The '922 patent needs to generate a clock signal ("target clock signal") which is synchronized with a reference clock signal. The two clock signals generally have unequal frequencies. For the purpose of illustration, the target clock signal may need to have a frequency of X/Y times the frequency of the reference clock signal, wherein X and Y are integers. To solve the above difficulty, the device in the '922 patent operates in conjunction with a rather complex method and apparatus for generating a target clock signal having a frequency of X/Y times the frequency of a reference clock signal, as discussed in a companion patent U.S. Pat. No. 6,157,376. The '376 patent discloses a clock generator circuit which provides for short comparison cycles even if X and Y do not have a large common denominator when a target clock signal having a frequency of (X/Y) times the frequency of a reference clock signal is to be generated. The comparison cycle is shortened by using approximately X/L and Y/L as divisors, instead of X and Y. As X/L and/or Y/L may not equal integers, multiple divisors may be used in a weighted fashion such that the weighted averages equal X/L or Y/L as the case may be.

SUMMARY

Systems and methods are disclosed for controlling a display device having a scan line (or display line) rate by storing incoming data in a buffer, the buffer having a usage level (for example fullness) measure; comparing the usage level to the scan line rate; and adjusting a period of a display line to avoid buffer overflow or underflow.

Advantages of the invention may include one or more of the following. The controller adjusts the display's scan line rate automatically with a relatively small internal memory. The up/down scaling (interpolation/decimation) can be achieved without requiring a large external frame buffer. The system flexibly generates video output clock signals having a frequency different from a reference input clock frequency. The system allows a display panel output clock rate to operate at a rate that is not preset with respect to input clock rate or frame rate. The system does not need to generate the target clock signal having a frequency of exactly X/Y times the frequency of a reference clock signal. This is done by snooping an internal memory usage level level and scan line rate as a basis to adjust the line buffers usage and scan line period (video width) automatically. This is done line by line to avoid the internal buffer over/under flow. The system achieves the same frame rate without keeping the rate between input data rate and output data rate. The system also avoids costly external frame memory and can perform image interpolation and decimation using a small amount of internal memory (FIFO SRAM).

The system operates off a simple phase locked loop that is economical to design since the PLL precision is not critical. The yield of resulting design is increased. The system also minimizes video input and video output clock jitters, which may vary due to temperature, process variation, or different input devices, for example. The system matches the output timing accordingly. The system avoids a costly external frame buffer and automatically handles uncertainties such as jitter in input and output clocks when the system operates in different environments.

BRIEF DESCRIPTION OF THE DRAWINGS

FIG. 5 shows an exemplary diagram of a post-processing circuit in FIG. 1B.

FIG. 6 shows data flow in the controller of FIG. 1.

FIG. 7 shows an exemplary vertical and horizontal scaling operation in the controller of FIG. 1.

DESCRIPTION

Figure 1A:
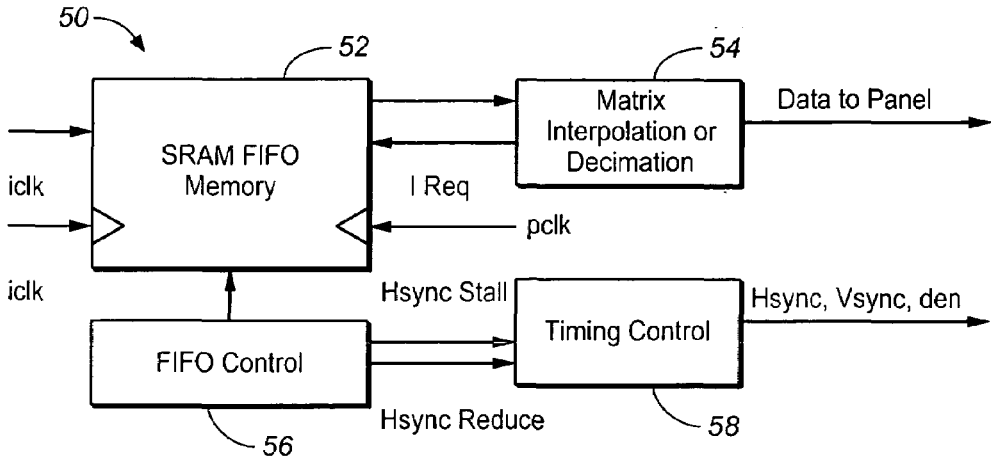
FIG. 1A shows one embodiment of a display controller.

Referring now to the drawings in greater detail, there is illustrated therein structure diagrams for a display controller and logic flow diagrams for processes a computer system will utilize to render images on a display panel, as will be more readily understood from a study of the diagrams.

FIG. 1A shows one example of a display controller 50 that controls various digital display devices such as liquid crystal displays, plasma displays and progressive-scan televisions, among others. In this embodiment, the display controller 50 is an LCD controller 50 that drives an LCD panel, The controller 50 has a buffer or memory 52 that receives incoming video data from an external source such as an analog to digital converter (ADC), a video decoder, a computer's graphics card, a digital video interface (DVI) source, or a suitable digital video player. In one embodiment, the buffer or memory 52 is a static random access memory (SRAM), which can be one or more single ported or double ported SRAMs with at least two outputs for which it could be read in parallel to process the image data and those data are fed into a matrix interpolation/decimation engine 54. The interpolation or decimation engine 54 reads vertical pixels in parallel, so that the horizontal and vertical pixels operation can be done in one circuitry by one matrix 2 D XY filtering operation. It has better performance over traditional horizontal, then Y direction scan line interpolation. The operation of the engine 54 is described in more detail below.

The incoming video data is clocked by an input (iclk). The buffer or memory 52 sends output data to the matrix interpolation or decimation engine 54 when the engine 54 sends a request signal Req to the memory 52. The buffer or memory 52 also receives a panel clock signal pclk. The panel clock can be generated from an internal phase locked loop (PLL). The system allows a display panel output clock rate to operate at a rate that is not preset with respect to input clock rate or frame rate. Rather, the input/output clock is automatically harmonized by snooping the internal memory 52's usage level level and the output video scan line rate as a basis to adjust the line buffer usage and scan line period (video width). Unlike the prior art, the system does not need to generate the target clock signal having a frequency of exactly X/Y times the frequency of a reference clock signal.

As a result, a simple PLL is used to generate the clock. The complexity of the method and apparatus for generating a target clock signal having a frequency of X/Y times the frequency of a reference clock signal disclosed in U.S. Pat. No. 6,157,376 is avoided.

In any given mode, if the panel required 1024×768 at 60 Hz, the pclk signal is set to the Video Electronics Standards Association (VESA) standard at 65 Mhz and not a fixed clock rate with respect to the iclk input clock. The output panel horizontal total count is also fixed according to the VESA standard (1344). The output of the matrix interpolation or decimation engine 54 is provided to the LCD panel.

The buffer or memory 52 is controlled by a buffer controller 56 The buffer controller 56 also drives a panel timing controller 58. The buffer controller 56 has a write pointer, a read pointer, full and empty flags which control the generation of a horizontal sync stall signal (HSYNC_STALL) and a horizontal sync contraction signal (HSYNC_REDUCE) for internal timing generation. The write pointer has the clock running by input clock which could be ADC, DVI or Video input clock. The read pointer clock is the signal pclk generated by the internal PLL which does not require a predefined clock rate with respect to the input clock.

The buffer controller 56 can assert HSYNC_STALL to lengthen the HSYNC pulse, or alternatively can assert HSYNC_REDUCE signal to contract the HSYNC pulse. The output of the timing controller 58 includes panel clock signals such as HSYNC (horizontal sync), VSYNC (vertical sync), and DEN (data enable).

The buffer controller 56 snoops the usage level of the buffer or memory 52. If the buffer or memory 52 status is in a certain range between predefined thresholds such that the output and input would not generate a full condition or an empty condition, the panel output horizontal pixel count is kept at a default VESA value (1344).

If the usage level of the memory or buffer 52 falls below this threshold by X clocks, the LCD panel display is retrieving video data so fast that it may cause the memory 52 to underflow. In this case, the buffer controller 56 then asserts HSYNC_STALL to request an HSYNC generator to slow down the HSYNC generation which in turn to increases the horizontal total pixel count from 1344 to 1344+X clocks before generating another HSYNC.

If the usage level of the memory or buffer 52 falls below this threshold by X clocks, the LCD panel display is retrieving video data so fast that it may cause the memory 52 to underflow. In this case, the buffer controller 56 then asserts HSYNC_STALL to request an HSYNC generator to slow down the HSYNC generation which in turn increases the horizontal total pixel count from 1344 to 1344 +X clocks before generating another HSYNC.

If the usage level of the memory or buffer 52 is above the thresholds by Y clocks, the LCD panel display operates at too slow a pace that may cause the internal memory 52 to overflow. In this case, the buffer control circuitry asserts HSYNC_REDUCE to make the HSYNC generator speed up the HSYNC generation which in turn decreases the horizontal pixel count from 1344 to (1344−Y) clocks before generating another HSYNC. The maximum value of X is set to a predetermined number, for instance, ¼ of display horizontal total (htotal). Any number above the exemplary example of ¼ of htotal is set to be ¼ of htotal.

In one embodiment, Y conforms to a minimum value determined as follows:

Htotal_nominal−Y>Horizontal display size

Default Horizontal total=Htotal_nominal

By adjusting the panel display horizontal total and HSYNC generation, the internal frame memory 52 may not overflow or underflow. Moreover, pclk does not need to have a pre-defined relationship with any input window mode or timing. In every HSYNC asserted, the interpolation/decimation engine 54 sends a request to the memory 52 (which in the example is a SRAM FIFO) to read the data to be interpolated or decimated. The rate is controlled by the buffer 52's usage level level. Since the buffer or memory control is automated, the buffer or memory 52 does not experience overflow and underflow and can be treated as a frame memory even though the memory 52 is much smaller than the actual display frame size.

Figure 1B:
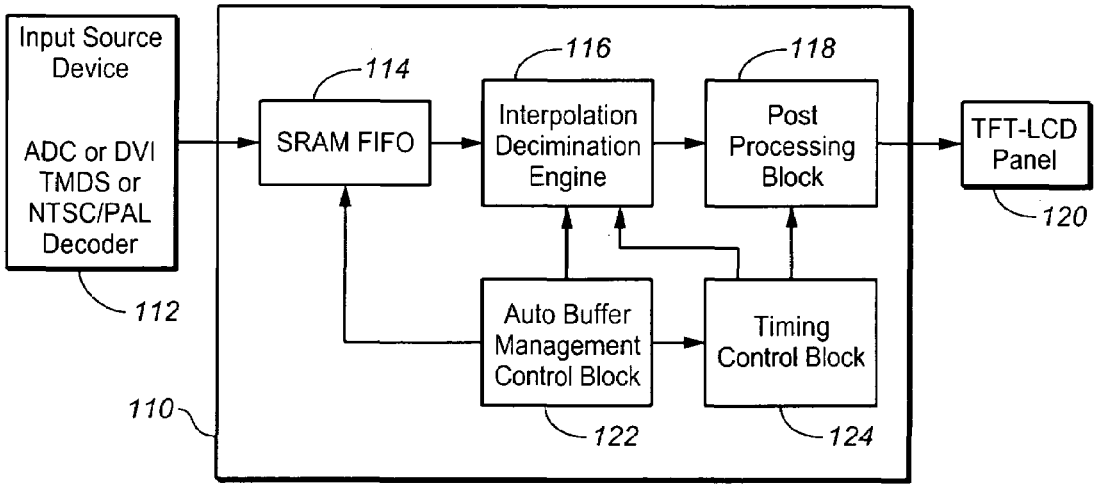
FIG. 1B shows a second embodiment of a display controller.

FIG. 1B shows a second embodiment of an LCD controller 110. The controller 110 receives input data from an input source device 112 and stores the data in a buffer or memory 114. The output of the buffer or memory 114 is provided to an interpolation/decimation engine 116 to also minimize the rendering jagged edges on the LCD. The interpolation decimation engine 116 provides its output to a post processing circuit or circuit or block 118, which enhances certain display characteristics, among others, the contrast, brightness, hue/saturation of the video to be rendered on the LCD. The output of the post processing circuit or block is presented to an LCD panel 120 for display. The buffer or memory 114 and the interpolation/decimation engine 116 are controlled by a buffer management control circuit or block 122. The buffer management control circuit or block 122 also controls a timing control circuit or block 124. In turn, the timing control circuit or block 124 clocks the interpolation/decimation engine 116 and the post processing circuit or block 118.

The input device 112 can be the output of an analog to digital converter (ADC) such as that from a computer video display card, a digital video input (DVI) source, or a digitized NTSC/PAL decoder. The input device 112 can be any suitable digital device for generating a digital bitstream suitable for rendering such as a computer, a DVD player, a VCR, or a multimedia unit to receive program data from one or more service providers and to display the program data for viewing. Such service or content providers can include terrestrial broadcasters, cable operators, direct broadcast satellite (DBS) companies, companies providing content for download via the Internet, or any similar such content and/or service provider.

The input data is provided to the buffer or memory 114. The buffer or memory 114 compensates for the differences in speed of the incoming and the outgoing circuitry through which the data must pass. In one embodiment, the memory 114 is high speed static random access memory (SRAM). However, the memory can be any suitable memory, including DRAM, EEPROMs, flash, and ferro-electric elements, for example.

In one embodiment, the memory 114 is configured as a ring buffer First In First Out (FIFO). The FIFO allows the matching of multiple asynchronous systems where incoming video operates at a significantly different clock frequency than outgoing video. The length of the FIFO is determined by the difference in clock rates and the amount of data to be buffered. The FIFO allows simultaneous access to the memory through two independent "write" and "read" pointers. Since the data is always contiguous, an address bus is not needed and data is read out in the same order in which it was received. Additionally, the FIFO provides a high limit pointer and a low limit pointer to clamp the horizontal line changes. The high limit pointer is used to limit the addition of clocks in the horizontal line, while the low limit pointer is used to limit the reduction of clocks in the horizontal line.

Internally, two flags provide information on the status of the memory array. Flag logic prevents illogical writes and reads from occurring. The "empty" flag indicates that the read and write cycle counts are equal, and will be automatically asserted after a reset, which functions to reset the cycle counters and returns both read and write pointers to memory address zero. The empty flag, therefore, prevents reading while empty, a data underflow condition. As a result, if the memory array is empty, a read cycle is inhibited until at least one data entry has been written. On the other hand, a usage level such as a "full" flag indicates that the write and read counts are at a maximum distance apart, which implies that a full load of data has been written to the FIFO and has not yet been read out. The full flag, therefore, prevents writing while full, a data overflow condition. If the memory array is full, a write cycle is inhibited until at least one data entry has been read out. Once data that has been stored at a given address is read, it can then be overwritten.

To illustrate, the system of FIG. 1B controls the LCD device 120 having a scan line rate. The buffer 114 receives video from the input source device 112 and stores the incoming data. The buffer 114 has a usage level measure, namely the high limit. The system of FIG. 1B compares the usage level, for example the buffer fullness measure to the scan line rate and adjusts a period of the scan line to avoid buffer overflow or underflow. The adjustment is done by adding or subtracting clocks to the output video clock pclk.

The system can perform interpolation or decimation on an image. In one embodiment, this is done by considering image diagonal characteristics. The diagonal characteristic determination is done by reading multiple vertical pixels simultaneously. The system can perform two-dimensional image filtering operations on the multiple vertical pixels. Post-processing is then performed before video data is sent to the display device, including adjusting contrast, adjusting brightness, adjusting hue and saturation, reducing noise, performing gamma correction, or enhancing a video image.

Figure 1C:
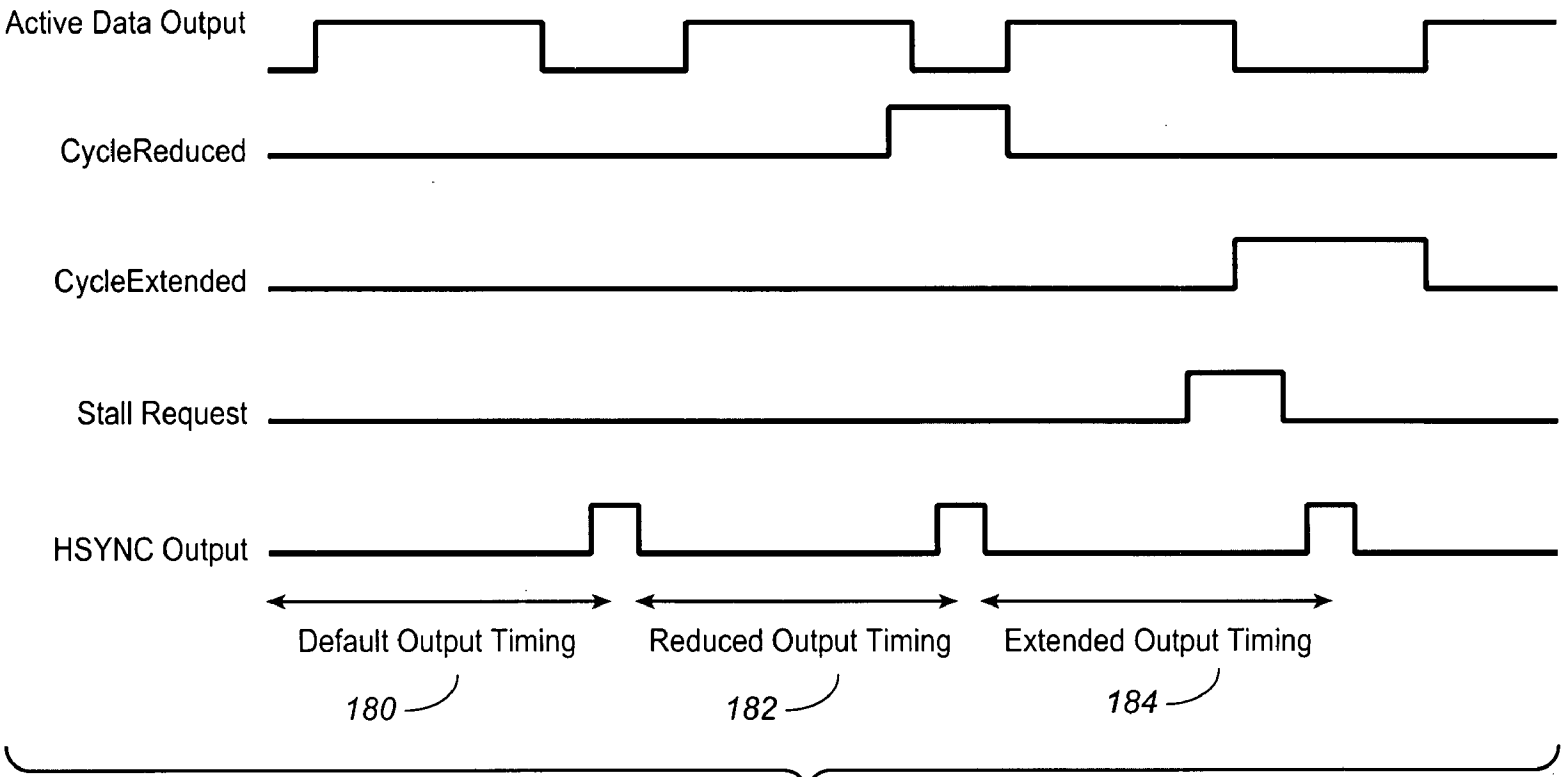
FIG. 1C shows various exemplary timing diagrams for the controller of FIG. 1B.

FIG. 1C shows an exemplary timing diagram illustrating the extension of a scan line period as well as the reduction of a scan line period based on the incoming video clock and the outgoing video clock. In FIG. 1C, an ActiveDataOutput signal is supplied by the video source device 112 and data is transmitted when this signal is asserted. The incoming data is stored in the buffer 114 with a usage level measure. A period 180 on the left of the diagram represents a default output rate with timing information such as Hsync output to the digital display device. A period 182 in the middle illustrates the timing when the buffer management control circuit or block 122 detects that the horizontal period needs to be reduced. In this case, a CycleReduced signal is asserted just before the ActiveDataOutput signal is deasserted to indicate that the period should be reduced by comparing the usage level to the outgoing scan line rate. The HSync period output is reduced to avoid buffer overflow. Correspondingly, a period 184 on the right illustrates the timing when the buffer management control circuit or block 122 detects that the horizontal period needs to be extended accordingly to avoid buffer underflow. In this case, a StallRequest signal is asserted, which eventually results in the assertion of a CycleExtended signal to indicate that the period should be increased.

Figure 2:
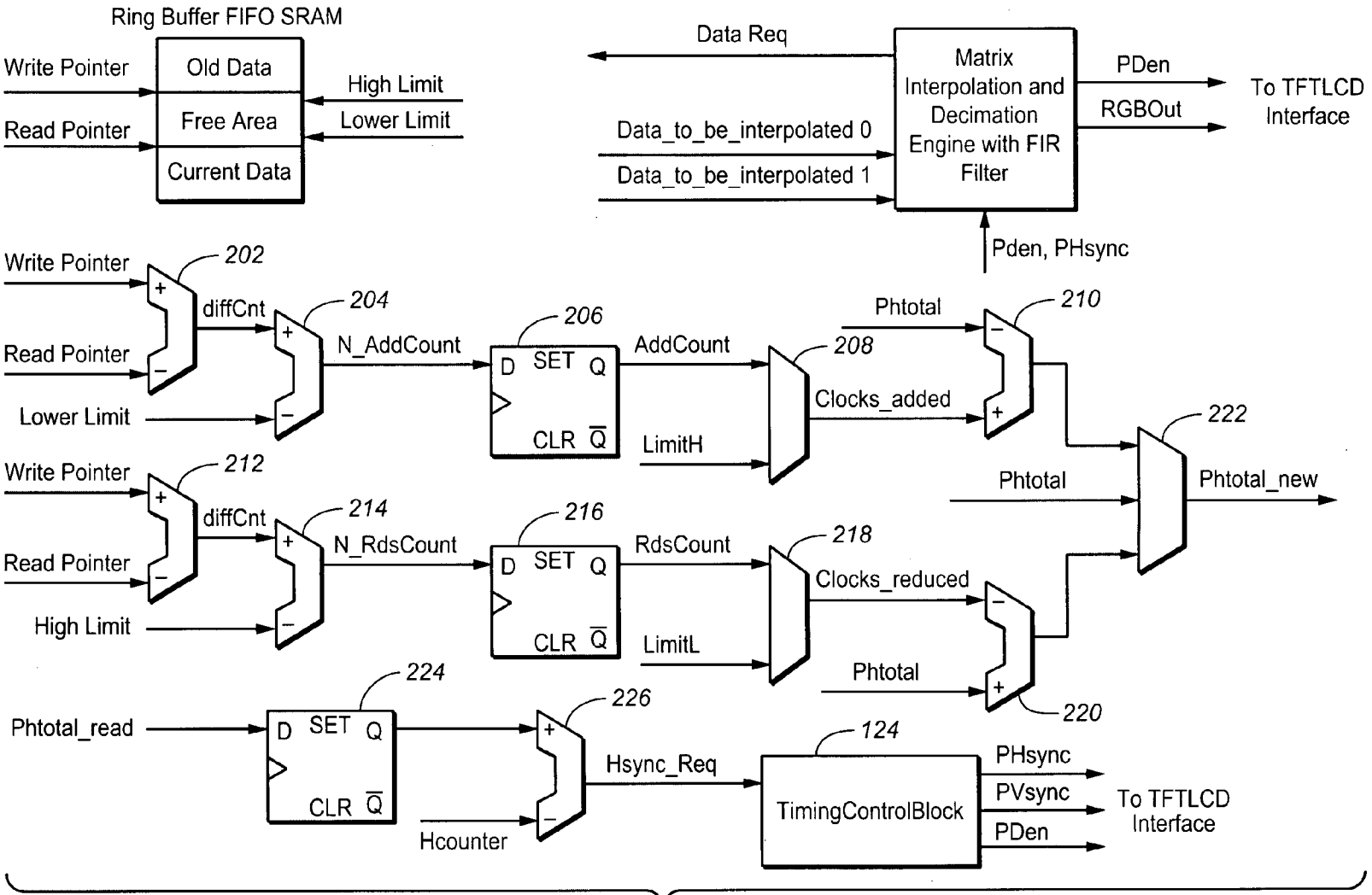
FIG. 2 shows an exemplary diagram of a buffer management control circuit in FIG. 1B.

FIG. 2 shows an exemplary diagram of one embodiment of the buffer management control circuit or block 122 in FIG. 1B. In FIG. 2, the write pointer and read pointer from the memory 114 (in one implementation, an SRAM configured as a FIFO buffer) are provided to an arithmetic logic unit (ALU) 202 whose output is provided to one input of an ALU 204. The other input of the ALU 204 is connected to a low limit value from a programmable register which may be accessible from a host or system controller. The output of the ALU 204 is latched by a flip-flop 206. The output of the.flip-f lop 206 is presented to one input of a multiplexer 208. The other input to the multiplexer 208 is the high limit pointer. The output of the multiplexer 208 is provided to an ALU 210, which adds the output of the multiplexer 208 to a Phtotal value received at the second input of the ALU 210. The output of ALU 210 represents a Phtotal with clocks added.

The write pointer and read pointer from the FIFO are also provided to an ALU 212 whose output is provided to one input of an ALU 214. The other input of the ALU 214 is connected to the high limit value from a programmable register which may be accessible from the host or system controller. The output of the ALU 214 is latched by a flip-flop 216. The output of the flip-flop 216 is presented to one input of a multiplexer 218. The other input to the multiplexer 218 is the low limit pointer. The output of the multiplexer 218 is provided to an ALU 220, which subtracts the output of the multiplexer 218 from the Phtotal value received at the a second input of the ALU 220. The output of ALU 220 represents the Phtotal value with clocks deducted therefrom.

The original Phtotal, the clock added Phtotal from the ALU 210, and the clock deducted Phtotal from the ALU 220, are received by a multiplexer 222 that selects one of the three values and presents the output to a latch 224. The latched value is provided to an ALU 226, which adds the latched value to a horizontal counter pointer to output a horizontal sync request signal that is provided to the timing control circuit or block 124. Verilog code f or one implementation of the buffer management control circuit or block 122 is attached in the appendix.

Figure 3:
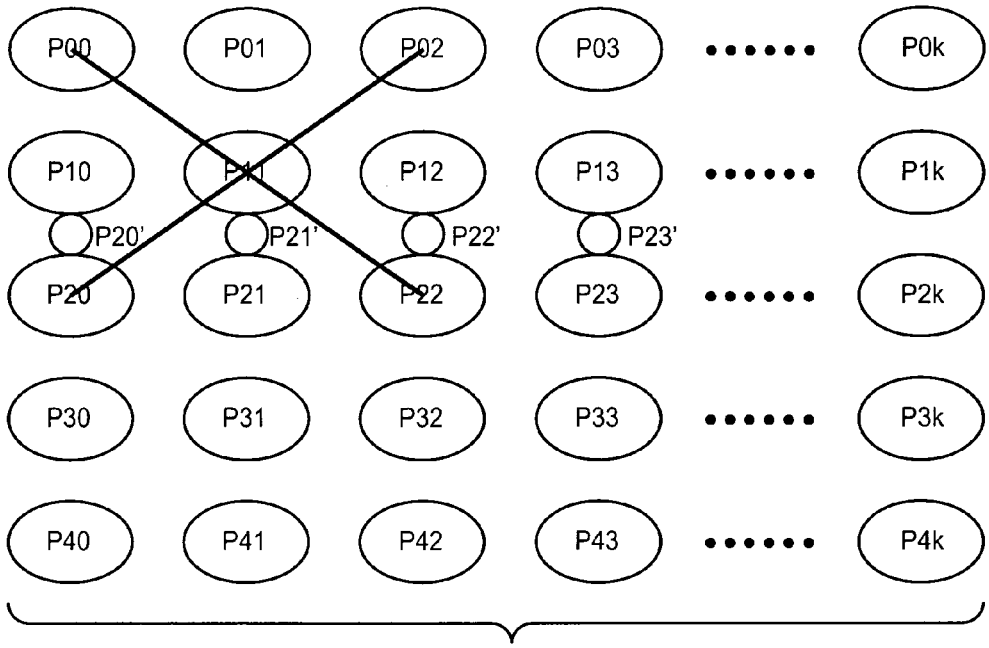
FIG. 3 shows an exemplary diagram illustrating the operation of an interpolation decimation engine in FIG. 1B.

FIG. 3 shows an exemplary diagram illustrating the operation of the interpolation/decimation engine 116 in FIG. 1B. The interpolation/decimation engine 116 processes image. data two-dimensionally so that the diagonal image .data is also considered to avoid jagged edges. Although conventional X−Y or Y−X interpolation engine can be used, the diagonal interpolation/decimation engine 116 is superior to engines that only consider XY or Y−X interpolation in image quality.

Referring now to FIG. 3, an array of rows of pixels is shown. In the first row, the pixels include P00, P01, P02, P03, . . . P0k. Correspondingly, in the second row, the pixels include P10, P11, P12, P13, . . . P1k; in the third row, the pixels include P20, P21, P22, P23, . . . P2k; in the fourth row, the pixels include P30, P31, P32, P33, . . . P3k; and in the fifth row, the pixels include P40, P41, P42, P43, . . . P4k. The array of rows is process in two stages:

Stage 1:

At pipeline k=1, if the current interpolation point is closer to P11.

p21'=(Coef01*P01+Coef11*P11+coef21*P21+coef31*P31)+SlopeK*(coef02*P02+coef20*P20+coef00*P00+coef22*P22)

where the SlopeK is the bilinear distance between P11 and P21.

Alternatively, if the current interpolation point is closer to P21:

p21'=(Coef11*P11+coef21*P21+coef31*P31+coef41*P41)+(1−SlopeK)*(coef10*P10+coef32*P32+coef12*P12+coef30*P30)

Stage 2:

Poutput=coef20*P20'+coef21*P21'+coef22*P22'+coef23'*P23 where the coefficient can be any programmable scaling, for example Cubic, Bicubic, Gaussian polyphase FIR, filter coefficients.

The interpolation/decimation engine 116 reads multiple vertical pixels simultaneously thus allowing a variety of 2-dimensional image filtering operations that produce better image quality than a traditional X-direction, then followed by Y-direction image filtering operation.

Figure 4:
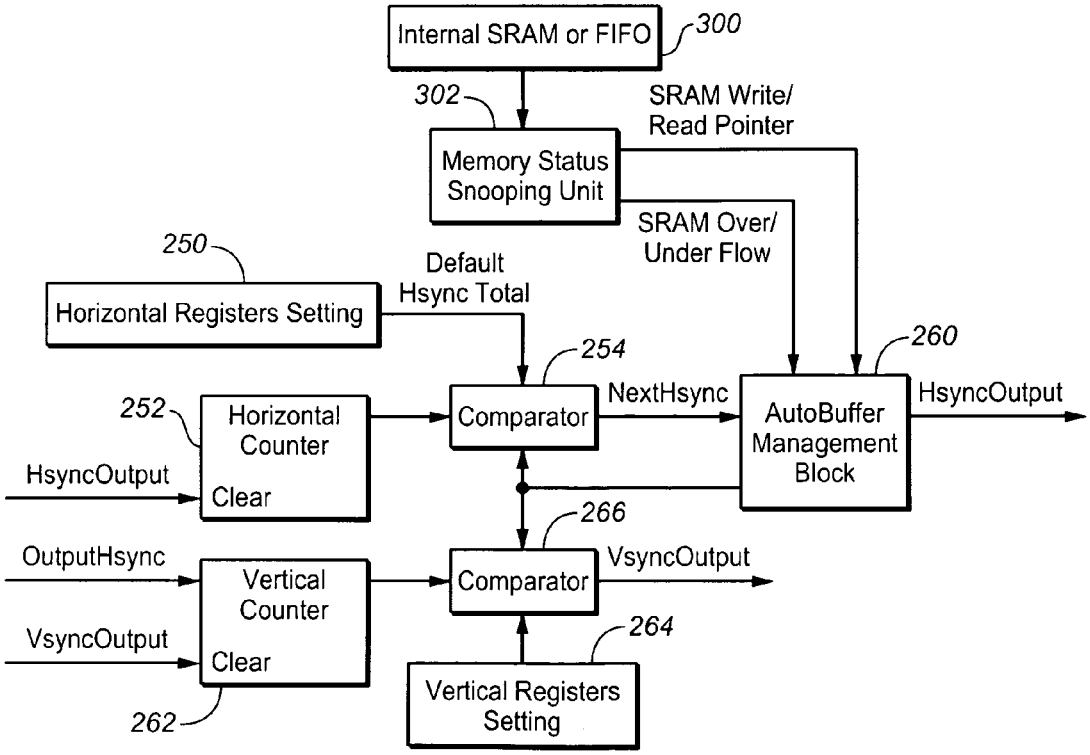
FIG. 4 shows an exemplary diagram of a timing control circuit in FIG. 1B.

FIG. 4 shows an exemplary diagram of one embodiment of the timing control circuit or block 124 in FIG. 1B. In FIG. 4, data from memory (in this case FIFO buffer) 300 is provided to a memory status snooping unit 302, which determines FIFO buffer overflow and underflow conditions as well as updates buffer read/write pointers. The outputs of the memory status snooping unit 302 are provided to a buffer management block 260 that outputs a horizontal sync output signal. The block 260 receives inputs from comparators 254 and 266. The comparator 254 receives a default HSync total from horizontal setting registers 250. The comparator 254 also receives signals from a horizontal counter 252. The counter 252 is reset when the horizontal sync signal is received.

Correspondingly, a vertical counter 262 is incremented by each output horizontal sync signal. It is cleared by a vertical sync output signal. The output of the vertical counter 262 is provided to the comparator 266. The comparator 266 also receives vertical setting information from vertical setting registers 264.

FIG. 5 shows an exemplary diagram of one embodiment of the post-processing circuit or block 118 in FIG. 1B. Data from the interpolation/decimation engine is provided to an edge enhancement block 304 to enhance image edges. After edge enhancement, data is provided to a contrast, brightness, hue, saturation adjustment block 306. Data is then provided to an on-screen 5 display (OSD) block 308. Next, the data is gamma corrected in gamma correction block 310. The output of the gamma correction block 310 is provided to a multiplexer 320.

The multiplexer 320 receives data from either the interpolation/decimation engine or an external video source. If external video is selected, the video source is provided to a contrast, brightness, hue, saturation adjustment block 312. Data is then provided to a picture overlay block 314. Next, the data is gamma corrected in gamma correction block 316. The output of the gamma correction block 316 is provided to the multiplexer 320.

FIG. 6 shows an exemplary data flow in the controller of FIG. 1. First, data is read from the SRAM FIFO and written into the matrix interpolation/decimation block. The matrix interpolation/decimation block then performs operation in FIG. 3. If the SRAM FIFO overflows or underflows, the interpolation block deactivates a data request signal input to the SRAM FIFO. The data then is provided to the post processing block. Typical post processing block operations may include contrast control, picture enhancement, brightness control, hue and saturation, noise reduction, Gamma correction, among others. Finally, the video data is output to the LCD panel interface.

FIG. 7 shows an exemplary vertical and horizontal scaling operation in the controller of FIG. 1. First, incoming data is horizontally scaled (702). The horizontally scaled data is presented to the ring buffer FIFO (704). Next, a diagonal Y-scaling operation is performed (706). Finally, a second horizontal scaling operation is performed (708). The process of FIG. 7 enables the LCD controller to scale up as well as scale down incoming video to match a particular LCD panel's characteristics.

Figure 8:
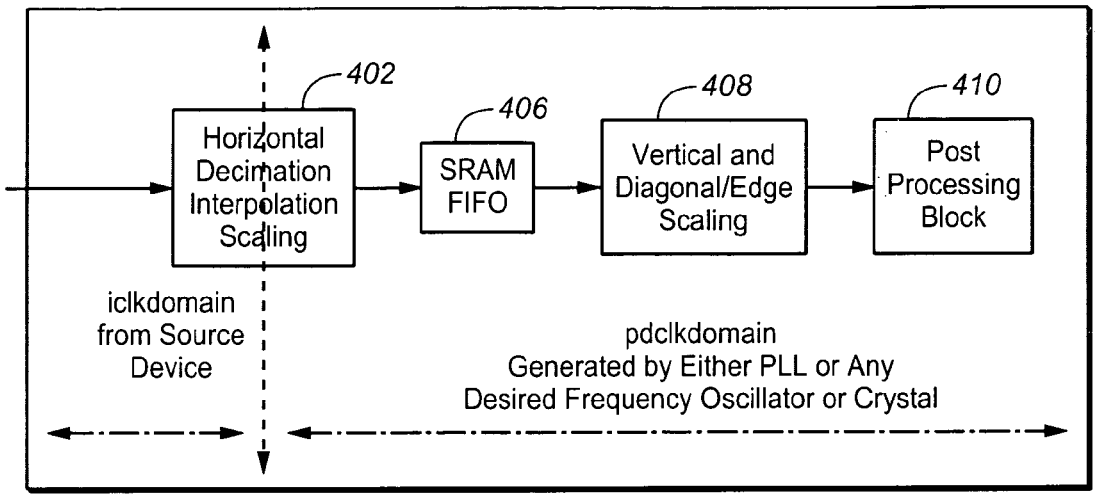
FIG. 8 shows an exemplary configuration to perform either upscaling or downscaling using the above system.

FIG. 8 shows an exemplary configuration to perform either upscaling or downscaling using the above system. The example in FIG. 8 further illustrates an advantageous application of the above system where, to minimize memory requirement, the system decimates the video/graphic signal before it flow to the internal memory (SRAM or FIFO).

In the configuration of FIG. 8, the above system is configured as follows: a horizontal decimation/decimation engine 402 provides data to memory (FIFO buffer) 406. The data from the FIFO 406 is provided to a vertical and diagonal edge scaling block 408. Finally, data is provided to a post processing block.

In a decimation (down-scaling) application, the interpolation/decimation engine uses the horizontal decimation engine first (It may or may not use the same horizontal interpolation/decimation circuitry in the video application).

When up-scaling (interpolation) an image, the first horizontal decimation/interpolation engine is used to upsize the image, which is subsequently stored in the internal memory (FIFO buffer or SRAM). The vertical/edge scaling engine 454 then reads the data to perform the diagonal and vertical scaling (interpolation) operations.

Figure 9:
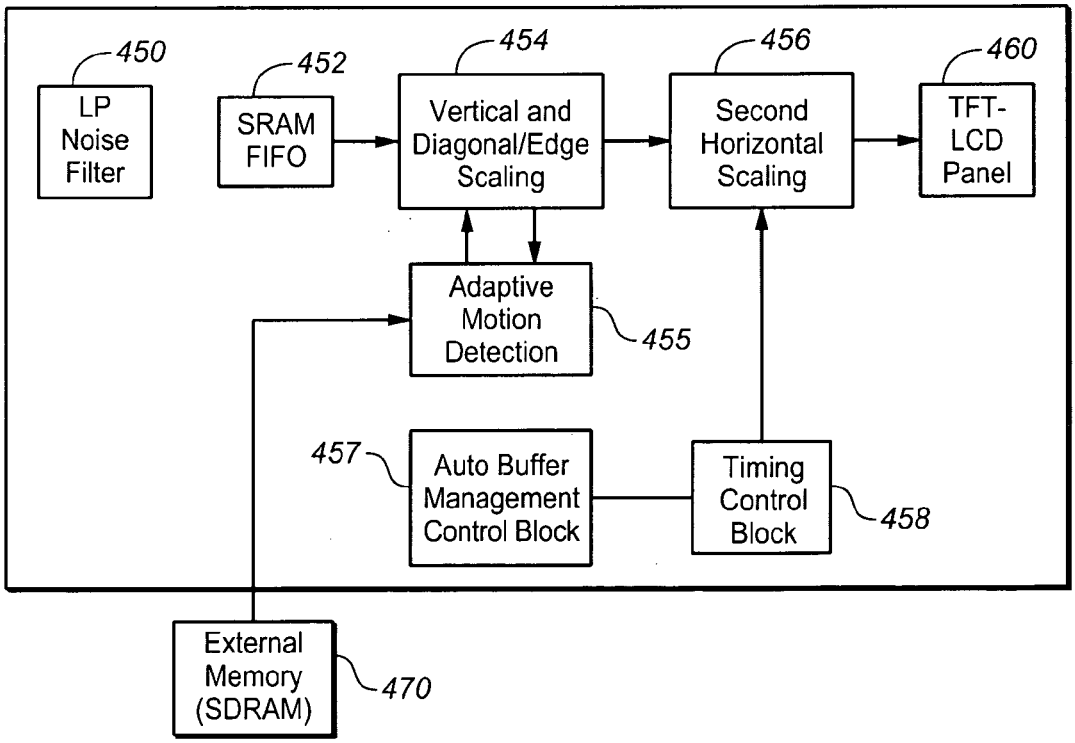
FIG. 9 shows an exemplary video deinterlacing application for the above system.

FIG. 9 shows an exemplary video deinterlacing application for the above system. In this exemplary configuration, video data is provided to a noise filter 450. In this case, the filter 450 is a low pass filter. The low-pass filtered data is stored in memory 452. Next, vertical and diagonal/edge scaling is performed in block 454. The output of the vertical and diagonal/edge scaling block 454 is provided to a second horizontal scaling block 456, which in turn drives an LCD panel 460.

The second horizontal scaling block 456 is controlled by a timing control block 458, which in turn is managed by an auto buffer management control block 457. The vertical and diagonal/edge scaling block 454 also communicates with an adaptive motion detection block 455, which receives data from external memory 470. The external memory 470 can be any suitable high density memory such as synchronous DRAM (SDRAM), for example.

In the video deinterlacing application, the interpolation/decimation engine performs vertical and diagonal scaling first. Next, the deinterlaced (After Motion adaptive and edge detection) video frame are processed by the horizontal scaling engine to meet the output requirement, because edge effect processing needs to be done prior to the horizontal interpolation engine.

The system complies with VESA's scaling arbitration. Thus, since the controller states support of more than one resolution in EDID, the host computer shall assume the LCD monitor supports scaling or centering and the host computer defaults to monitor scaling. However, the host can still perform scaling at the user's option. The system lists the video modes that are supported with a quality image (centering or scaling) to the host computer.

It is to be understood that various terms employed in the description herein are interchangeable. Accordingly, the above description of the invention is illustrative and not limiting. Further modifications will be apparent to one of ordinary skill in the art in light of this disclosure.

The invention has been described in terms of specific examples which are illustrative only and are not to be construed as limiting. The invention may be implemented in digital electronic circuitry or in computer hardware, firmware, software, or in combinations of them.

Apparatus of the invention may be implemented in a computer program product tangibly embodied in a machine-readable storage device for execution by a computer processor; and method steps of the invention may be performed by a computer processor executing a program to perform functions of the invention by operating on input data and generating output. Suitable processors include, by way of example, both general and special purpose microprocessors. Storage devices suitable for tangibly embodying computer program instructions include all forms of non-volatile memory including, but not limited to: semiconductor memory devices such as EPROM, EEPROM, and flash devices; magnetic disks (fixed, floppy, and removable); other magnetic media such as tape; optical media such as CD-ROM disks; and magneto-optic devices. Any of the foregoing may be supplemented by, or incorporated in, specially-designed application-specific integrated circuits (ASICs) or suitably programmed field programmable gate arrays (FPGAs).

While the preferred forms of the invention have been shown in the drawings and described herein, the invention should not be construed as limited to the specific forms shown and described since variations of the preferred forms will be apparent to those skilled in the art. Thus the scope of the invention is defined by the following claims and their equivalents.

APPENDIX

```
'timescale          10ps/10ps
module autobuf (
                    start,
                    nhs,
                    setover, setunder,
                    rd1__line, rd4__line,
                    wr__line,wrptr,rdptr,
                    size,
                    limitL,limitH,phtotal,
                    vs,hs,
                    phact,phcnt, p1st, endh,
                    autobufen,
                    den,ivs,
                    in__ysize,
                    iclk, irstN,
                    pclk, prstN
                    );
output      nhs,start;
output      setover, setunder;
input       [2:0] wr__line, rd1__line, rd4__line;
input       [10:0] size;
input       [10:0] wrptr, rdptr, in__ysize;
input       vs,hs,ivs, den;
input       [10:0] phcnt,phtotal;
input       [7:0] limitL, limitH;
input       phact, p1st,endh;
input       iclk, irstN,pclk, prstN;
input       autobufen;
parameter d1 = 100;
dffsc__ HDS1__DFF ( hs__d1, hs, pclk, prstN);
wire [12:0] bufferarea = {1'b0,size, 1'b0}; // 2x line size
wire [12:0] low__limit = {bufferarea - size[10:1]};
wire [12:0] high__limit = {bufferarea + size[10:1]};
//
reg [10:0] hline__total; // Estimate htotal by using first DH__rate to latch
the hcnt
always @(posedge pclk or negedge prstN)
        if (!prstN)
                hline__total <= #d1 11'h7ff;
        else if ( p1st & endh)
                hline__total <= phcnt;
reg phact__d1;
always @(posedge pclk or negedge prstN)
if (!prstN)
        phact__d1 <= #d1 1'b0;
else
```

APPENDIX-continued

```
        phact__d1 <= #d1 phact;
wire #d1 pend = phact__d1 & (!phact);
wire [2:0] linedif = wr__line - rd4__line;
reg [12:0] difh;
always @( linedif or wrptr[10:0] or size[10:0] )
begin
        case(linedif) //synopsys parallel__case full__case
        3'h1 : difh = {1'b0,wrptr[10:0]};
        3'h2 : difh = {1'b0,wrptr[10:0]} + {1'b0,size[10:0]};
        3'h3 : difh = {1'b0,wrptr[10:0]} + {size[10:0], 1'b0};
        3'h4 : difh = {1'b0,wrptr[10:0]} + {size[10:0], 1'b0} +
{1'b0,size[10:0]};
        default : difh = wrptr[10:0];
        endcase
end
reg [12:0] diff;
always @(posedge pclk or negedge prstN)
if (!prstN)
        diff<= #d1 13'h0;
else
        diff<= #d1 difh;
wire [12:0] addcnt = (low__limit - diff );
wire [12:0] rdscnt = (diff- high__limit );
reg [12:0] addmorecnt, rdsmorecnt;
wire #d1 add__clock = (diff < low__limit ) & pend;
wire #d1 rds__clock = (diff > high__limit ) & pend;
rsffsc__ ADD__DFF( add, add__clock, hs__d1, pclk, prstN);
rsffsc__ RDS__DFF( rds, rds__clock, hs__d1, pclk, prstN);
dffsc__ ADD__DLY1(add__d1, add, pclk, prstN);
dffsc__ RDS__DLY1(rds__d1, rds, pclk, prstN);
always @(posedge pclk) if (add__clock) addmorecnt <= #d1 addcnt;
always @(posedge pclk) if (rds__clock) rdsmorecnt <= #d1 rdscnt;
wire [7:0] addmore__clocks =( addmorecnt[12:0] >= {5'h0,limitH } ) ?
                                limitH :
                                addmorecnt [7:0];
wire [7:0] clock__added__n = add? addmore__clocks : 8'h0;
reg [7:0] clock__added;
always @(posedge pclk) clock__added <= clock__added__n;
wire [7:0] clock__rduced__n = rds?
endmodule
                        ( (rdsmorecnt > {5'h0,limitL})? {1'b0,limitL}
:
                        rdsmorecnt[8:0] ): 8'h0;
reg [7:0] clock__rduced;
always @(posedge pclk) clock__rduced<= clock__rduced__n;
wire [10:0] htotal__new__n = add__d1? ({ 2'b0, clock__added } +
phtotal[10:0]):
                    rds__d1? ( phtotal[10:0] - {2'b0, clock__rduced} ):
                    phtotal;
reg [10:0] htotal__new;
always @(posedge pclk ) htotal__new <= #d1 htotal__new__n;
wire line__adj;
wire start =    autobufen & line__adj;
wire nhs = ((phcnt == htotal__new) & start)? 1:0;
dffsc__ IDEN__DFF( den__d1, den, iclk, irstN);
dffsc__ IDEN1__DFF( den__d2, den__d1, iclk, irstN);
wire #d1 n__denp = (den__d2) & (!den__d1);
dffsc__ IDEN2__DFF( denpt, n__denp, iclk, irstN);
syncdffsc__ SYNCDEN( denp, pclk, prstN, denpt, iclk, irstN );
syncdffsc__ SYNCDEN1( vsp, pclk, prstN, ivs, iclk, irstN );
reg [10:0] inpcnt;
always @(posedge pclk or negedge prstN)
begin
        if (!prstN)
                inpcnt <= #d1 11'h0;
        else if (vsp )
                inpcnt <= #d1 11'h0;
        else if ( denp)
                inpcnt <= inpcnt + 1'b1;
end
wire #d1 n__line__adj = (inpcnt>=5) & (inpcnt < in__ysize );
dffsc__ LINE__ADJ__DFF( line__adj, n__line__adj, pclk, prstN);
wire setover =0;
wire setunder =0;
```

What is claimed is:

1. A method for controlling a display device having a scan line rate, comprising:

storing incoming data in a buffer, the buffer having a usage level measure;

comparing the usage level to the scan line rate;

generating a first control signal configured to contract the period of a horizontal sync (HSYNC) signal in response to said usage level exceeding a first predetermined threshold;

generating a second control signal configured to lengthen the period of said horizontal sync (HSYNC) signal in response to said usage level falling below a second predetermined threshold;

generating a third control signal configured to set a default period of said horizontal sync (HSYNC) signal;

multiplexing said first control signal, said second control signal and said third control signal to generate a request signal; and adjusting a period of said horizontal sync (HSYNC) signal in response to said request signal to avoid buffer overflow or underflow.

2. The method of claim 1, further comprising snooping the usage level of the buffer.

3. The method of claim 1, further comprising automatically performing scaling up or scaling down an image.

4. The method of claim 1, further comprising performing interpolation or decimation on an image.

5. The method of claim 4, wherein the performing interpolation or decimation further comprises determining image diagonal characteristics.

6. The method of claim 5, further comprising reading multiple vertical pixels simultaneously.

7. The method of claim 6, further comprising performing two-dimensional image filtering operations on the multiple vertical pixels.

8. The method of claim 5, wherein the storing further comprises forming a First In First Out (FIFO) ring buffer.

9. The method of claim 1, further comprising performing post-processing on video data going to the display device.

10. The method of claim 9, wherein the post-processing further comprises adjusting contrast, adjusting brightness, adjusting hue and saturation, reducing noise, performing gamma correction, or enhancing a video image.

11. The method according to claim 1, wherein:

generating first control signal comprises the steps of (i) determining a difference between a write pointer of the buffer and a read pointer of the buffer, (ii) determining a first number of clock cycles by which the difference between the write pointer and the read pointer exceeds the first predetermined threshold by subtracting the first predetermined threshold from the difference between the write pointer and the read pointer and (iii) adding the first number of clock cycles to the default period of the horizontal sync (HSYNC) signal; and generating said second control signal comprises (i) determining the difference between the write pointer of the buffer and the read pointer of the buffer, (ii) determining a second number of clock cycles by which the difference between the write pointer and the read pointer falls below the second predetermined threshold by subtracting the second predetermined threshold from the difference between the write pointer and the read pointer and (iii) subtracting the second number of clock cycles from the default period of the horizontal sync (HSYNC) signal, wherein the default period of the horizontal sync (HSYNC) signal is expressed as a number of clock cycles.

12. The method according to claim 11, further comprising:

limiting the first number of clock cycles to a value equal to or less than a first predetermined limit value; and limiting the second number of clock cycles to a value equal to or less than a second predetermined limit value.

13. The method according to claim 12, wherein the first predetermined threshold, the second predetermined threshold, the first predetermined limit value and the second predetermined limit value are programmable.

14. A controller for a digital display, comprising:

a buffer to receive image data, the buffer having a usage level measure;

a timing controller to drive the display having a scan line rate; and a buffer controller coupled to the buffer and the timing controller, the buffer controller snooping the usage level of the buffer, comparing the usage level to the scan line rate, and adjusting a horizontal sync (HSYNC) signal to avoid buffer overflow or underflow, wherein said buffer controller is further configured (i) to generate a first control signal configured to contract the period of said horizontal sync (HSYNC) signal in response to said usage level exceeding a first predetermined threshold, (ii) to generate a second control signal configured to lengthen the period of said horizontal sync (HSYNC) signal in response to said usage level falling below a second predetermined threshold, (iii) to generate a third control signal configured to set a default period of said horizontal sync (HSYNC) signal and (iv) to multiplex said first control signal, said second control signal, and said third control signal to generate a horizontal sync request signal.

15. The controller of claim 14, further comprising an interpolation decimation engine coupled to the buffer, the interpolation decimation engine minimizing diagonal image jaggedness.

16. The controller of claim 15, further comprising a post-processing circuit coupled to the interpolation decimation engine and the timing controller.

17. The controller of claim 14, wherein the digital display is one of liquid crystal displays, plasma displays and progressive-scan televisions.

18. The controller of claim 14, wherein the buffer controller receives at least two lines of display and processes the lines at same time.

19. The controller of claim 14, wherein the buffer controller performs interpolation or decimation on an image.

20. The controller of claim 19, wherein the buffer controller further analyzes image diagonal characteristics.

21. The controller of claim 14, wherein the buffer controller changes a line width to adjust the line rate.

22. A method for controlling a liquid crystal display (LCD) panel with an LCD horizontal sync (HSYNC) signal, comprising:

storing incoming data in a buffer according to a first clock and retrieving outgoing data from the buffer according to a second clock, the buffer having a usage level measure;

comparing the usage level to a range determined by a first predetermined threshold and a second predetermined threshold;

generating a horizontal sync request signal in response to (i) a first control signal configured to contract a period of the HSYNC signal by a first number of cycles of the second clock by which the usage level is above the first predetermined threshold, (ii) a second control signal configured to lengthen the period of the HSYNC signal by a second number of cycles of the second clock by which the usage level is below the second predetermined threshold and (iii) a third control signal configured to set a default period of the HSYNC signal to a predetermined number of cycles of the second clock when the usage level is in the range between the first predetermined threshold and the second predetermined threshold; and adjusting a period of the HSYNC signal in response to the horizontal sync request signal.

23. A liquid crystal display (LCD) controller, comprising:

a buffer configured to receive image data according to a first clock and present image data according to a second clock, the buffer having a usage level measure;

an interpolation/decimation engine coupled to the buffer, the interpolation/decimation engine minimizing diagonal image jaggedness;

a timing controller coupled to the interpolation/decimation engine;

a buffer controller coupled to the buffer, the interpolation/decimation engine and the timing controller, the buffer controller (a) snooping the usage level of the buffer, (b) comparing the usage level to a range determined by a first predetermined threshold and a second predetermined threshold, (c) generating a horizontal sync request signal in response to (i) a first control signal configured to contract a period of a LCD horizontal sync (HSYNC) signal by a first number of cycles of the second clock by which the usage level is above the first predetermined threshold, (ii) a second control signal configured to lengthen the period of said LCD horizontal sync (HSYNC) signal by a second number of cycles of the second clock by which the usage level is below the second predetermined threshold, and (iii) a third control signal configured to set a default period of said horizontal sync (HSYNC) signal to a predetermined number of cycles of the second clock when the usage level is in the range between the first predetermined threshold and the second predetermined threshold and (d) adjusting the period of said LCD horizontal sync (HSYNC) signal in response to said horizontal sync request signal; and a post-processing circuit coupled to the interpolation/decimation engine and the timing controller.

* * * * *